US005690543A

United States Patent [19]

Curran

[11] Patent Number: 5,690,543

[45] Date of Patent: Nov. 25, 1997

[54] INTERNAL PIPE BLASTING NOZZLE

[76] Inventor: Ed Curran, 830 S. Northlake Dr., Hollywood, Fla. 33019

[21] Appl. No.: 727,180

[22] Filed: Oct. 8, 1996

[51] Int. Cl.[6] ..... B24C 5/04

[52] U.S. Cl. ..... 451/76; 451/102

[58] Field of Search ..... 451/102, 76, 90, 451/38, 39, 40

[56] References Cited

U.S. PATENT DOCUMENTS 4,713,882 12/1987 Bianchi et al. ..... 451/76

FOREIGN PATENT DOCUMENTS 2952622 7/1981 Germany ..... 451/76

810812 1/1959 United Kingdom ..... 451/102

*Primary Examiner*—Robert A. Rose

*Attorney, Agent, or Firm*—Herbert L. Lerner; Laurence A. Greenberg

[57] ABSTRACT

A blasting nozzle assembly is used for blast cleaning internal pipe surfaces. A cylindrical sleeve has a flow channel through which blasting abrasive and a carrier fluid flow in a flow direction. A web member is integrally formed with the sleeve and extends diametrically across the flow channel. The web member has a length inside the flow channel which is about 60% to 90% of the given length of the sleeve. A stem is inserted in an opening formed in the web member such that the stem extends coaxially with the sleeve. A free end of the stem protrudes from the sleeve. A deflection tip is mounted on the free end of the stem. The deflection tip radially deflects the blasting abrasive and the carrier fluid arriving from the flow channel in the given flow direction.

6 Claims, 1 Drawing Sheet

INTERNAL PIPE BLASTING NOZZLE

BACKGROUND OF THE INVENTION

1. Field of the Invention

The invention relates to abrasive blast-cleaning, and in particular to a nozzle for the abrasive blast-cleaning of internal pipe surfaces. The field is commonly referred to as abrasive blasting or sand blasting.

2. Description of the Related Art

There has been known heretofore a blasting nozzle of this general type which is sold by Clemco Industries, Montana, under the name "Hollo-Blast Jr". That nozzle, which will be described in more detail with reference to the drawing, includes a cylindrical pipe which holds a Venturi nozzle, a stem projecting coaxially in the pipe and a deflection tip at a forward end of the stem. A carrier fluid (e.g. air, water) with a proportion of abrasive particles is forced through the pipe in a generally axial direction. The fluid is accelerated by the Venturi nozzle and the deflection tip then forces the fluid with the abrasive radially outward. The fluid jets and the abrasive particles impinge on the inner pipe surface to be cleaned and they remove scale and other buildup from the inner surface of the pipe.

The stem which holds the deflection tip is mounted within the nozzle pipe by means of a web member which extends diametrically across the pipe. The web member, which has a slightly greater width than the inner diameter of the nozzle pipe engages in axial grooves which are formed diametrically across from one another in the inner pipe wall.

The abrasive effect of the abrasive particles are, of course, desirable with respect to the inner pipe wall surfaces to be cleaned. The blast nozzle, however, is subjected to the same abrasive effect. The useful life, therefore, of the blast nozzle is quite short. More specifically, this inventor has found that the web member which holds the stem at the axial center of the nozzle pipe is particularly prone to early disintegration.

SUMMARY OF THE INVENTION

It is accordingly an object of the invention to provide an internal pipe blasting nozzle, which overcomes the above-mentioned disadvantages of the heretofore-known devices and methods of this general type and which is appreciably improved with regard to the duration of its operational life.

With the foregoing and other objects in view there is provided, in accordance with the invention, a blasting nozzle assembly for blast cleaning internal pipe surfaces, comprising:

- a cylindrical sleeve having a given length and a central axis, the sleeve defining a flow channel through which blasting abrasive and a carrier fluid can flow in a given flow direction;
- a web member integrally formed with the sleeve and extending diametrically across the flow channel, the web member having a length inside the flow channel being at least 60% of the given length of the sleeve, and the web member having an opening formed therein extending coaxially with the axis of the sleeve;
- a stem inserted in the opening of the web member, the stem extending coaxially with the sleeve and having a free end protruding from the sleeve; and
- a deflection tip mounted on the free end of the stem for radially deflecting the blasting abrasive and the carrier fluid flowing in the given flow direction.

In accordance with an added feature of the invention, there is also provided a Venturi nozzle member integrally and coaxially formed on the inner sleeve at a forward end of the sleeve in the given flow direction. Preferably, the inner sleeve, the web member, and the Venturi nozzle member are a single-piece unitary structure. It is thereby possible to insert and clamp the unitary structure directly into a conventional blast hose and to eliminate the need for a conventional lance.

In accordance with a further feature of the invention, the single-piece unitary structure is formed of tungsten carbide.

In accordance with a concomitant feature of the invention, the web member has a length inside the flow channel being at least 80%, and preferably even up to 90%, of the given length of the sleeve. The relatively long web member provides superior support for the stem.

Other features which are considered as characteristic for the invention are set forth in the appended claims.

Although the invention is illustrated and described herein as embodied in an internal pipe blasting nozzle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
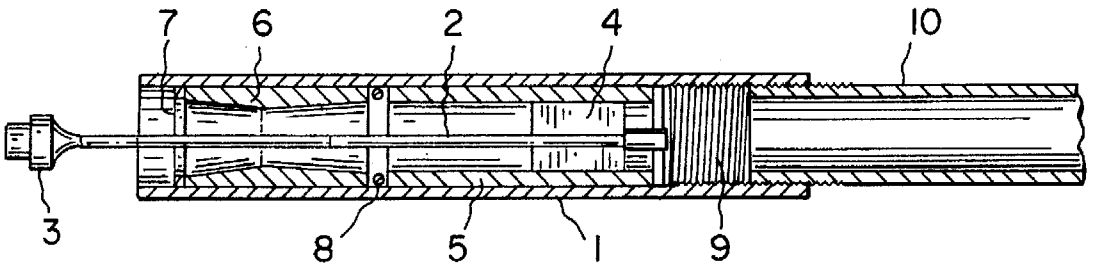
FIG. 1 PRIOR ART
FIG. 1 is an axial section of a prior art blast nozzle.

Referring now to the figures of the drawing in detail and first, particularly, to FIG. 1 thereof, there is seen a blast nozzle pipe 1 in which a stem 2 with a forward deflection tip 3 is mounted. An air/abrasive material mixture is blasted through the pipe (from right to left) and it is deflected at the deflection tip 3. The radial flow then impinges on an inner wall surface of a pipe to be cleaned in the blasting operation.

The stem 2 is held strictly coaxially within the nozzle pipe 1 by means of a web member 4. The web member 4 extends diametrically through the pipe 1 and it is formed with a central opening through which the stem 2 projects. The web member 4 is attached to an inner sleeve 5 which is slid into the pipe 1. A Venturi nozzle member 6 is disposed forward of the sleeve 5. The nozzle member 6 abuts against a stop ring 7 which is welded into the pipe 1, just inside the forward tip of the pipe 1. An O-ring seal 8 is disposed between the nozzle 6 and the sleeve 5. Towards the rear, the sleeve may be held against sliding out of the pipe 1 by a non-illustrated lock ring which is threaded into the pipe at an inner thread 9. A lance 10 is threadingly connected to the nozzle pipe 1 at the rear end thereof. The lance 10 may be chosen to correspond to a length of the pipe to be cleaned. At a non-illustrated end thereof, the lance 10 is water-tightly connected to a non-illustrated supply hose.

Figure 2:
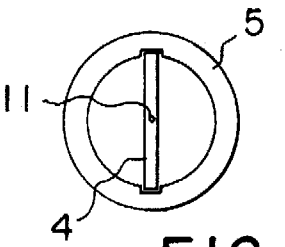
FIG. 2 PRIOR ART
FIG. 2 is an elevational axial view of an inner sleeve and web member assembly.

With reference to FIG. 2, the web member 4 is formed of a platelet which is welded into the sleeve 5. Shallow grooves are formed for that purpose in the inner wall surface of the pipe such that the platelet forming the web member 4 may be axially slid into the sleeve 5 and then welded or soldered into the grooves. The grooves are formed exactly diametrically opposite one another, such that a stem support opening 11 formed axially through the web member 4 comes to lie exactly on the pipe axis. The exact central and axial alignment of the stem support opening 11 is important in that it defines the exact central alignment of the stem 2 and the central positioning of the deflection tip 3. The prior art web member 4 has a length (along the stem axis) which is less than half of an axial length of the inner sleeve 5.

Figure 4:
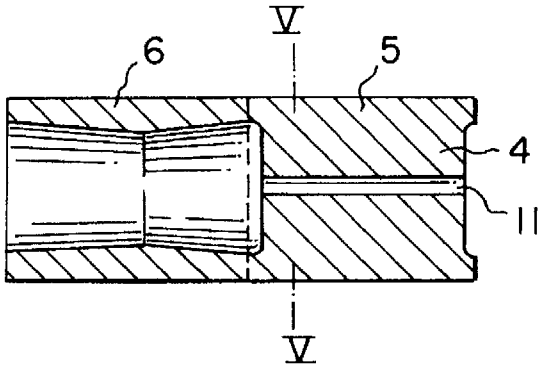
FIG. 4 is an axial section taken along the line IV—IV of FIG. 3 and viewed in the direction of the arrows.
Figure 5:
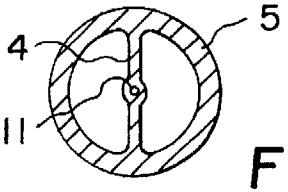
FIG. 5 is section taken along the line V—V of FIG. 4.
Figure 3:
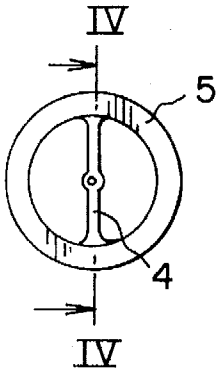
FIG. 3 is a similar view of an inner sleeve and web member unit according to the invention.

Referring now to FIGS. 3–5, the nozzle according to the invention deviates from the prior art system in that the inner sleeve 5 and the web support member—and possibly also including the Venturi nozzle member 6—are formed as a single piece integral unit. The major advantage attained with the single unit is the fact that, in many circumstances, it is not necessary to provide a nozzle pipe 1, but instead the single unit may be directly inserted into a conventional blast hose. In addition, the need for a lance is thereby eliminated. A dashed line in FIG. 4 shows the dividing line between the sleeve/web unit 5/4 on the one hand and the Venturi nozzle member 6 on the other hand.

The stem support member 4 of the invention (as illustrated) is essentially of the same length as the inner sleeve 5 itself. It has been found that the length of the web support member 4 should be at least 60% of that of the inner sleeve 5. Preferably, it is between 80% and 90%. The support strength and the wear resistance of the web member 4 is thereby immensely improved. The unit 4/5/6 is integrally formed of high-resistance tungsten carbide and it is preferably manufactured with EDM (electrical discharge machine) processing. It has been found that the single unit has a substantially longer operational life with regard to later (radial) wear (it is a problem associated with the prior art structure that the inner sleeve 5 has a tendency to wear through laterally).

Figure 6:
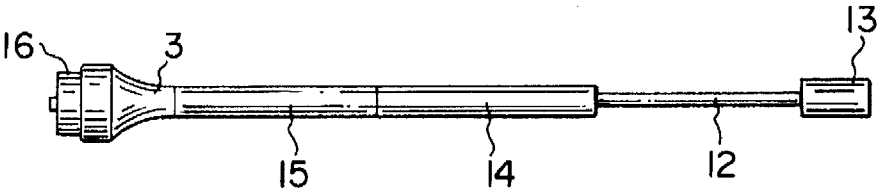
FIG. 6 is an elevational view of a stem with a deflection tip.

With reference to FIG. 6, the stem and deflection tip assembly includes a inner stem 12 with an outer diameter corresponding as nearly as possible to the opening 11 formed in the stem support member 4. A lock sleeve 13 is rigidly and permanently fastened at a back end of the inner Stem 12 (e.g. by welding). Two spacer sleeves 14 and 15 of tungsten carbide or a similarly resistant material are slipped onto the inner stem 12. The length of the inner stem 12 which is left exposed (only in FIG. 6, of course), corresponds to the axial length of the opening 11, i.e., of the length of the web support 4. The deflection tip 3 is also slipped onto the inner stem 12 and it abuts against the sleeve 15. Finally, a nut 16 is threaded onto the forward end of the inner stem 12.

The assembly of the unit is as follows: First, the inner stem 12 is inserted into the opening 11 from right to left in FIG. 4. Then the sleeves 14 and 15 are slipped onto the step, and the right-hand end of the sleeve 14 comes to abut against the left-hand face end of the stem support 4. At this point, the deflection tip 3 is slipped on and then the nut 16 is threaded onto the inner stem 12, until the web support is rigidly clamped between the lock sleeve 13 and the sleeve 14. The nozzle unit thus formed is then either inserted into the pipe 1, similarly to the prior art system, or it is directly placed into a blasting hose.

The blasting materials preferably used in the system according to the invention are carbon slag (processed boiler residue) and the like. The term "sand-blasting" as it is used herein should be understood in a generic sense and should in no way limit the system to blasting with sand. Any suitable blasting abrasive is included.

I claim:

1. A blasting nozzle assembly for blast cleaning internal pipe surfaces, comprising:

a cylindrical sleeve having a given length and a central axis, said sleeve defining a flow channel through which blasting abrasive and a carrier fluid can flow in a given flow direction;

a web member integrally formed with said sleeve and extending diametrically across said flow channel, said web member having a length inside said flow channel being at least 60% of the given length of said sleeve, and said web member having an opening formed therein extending coaxially with said axis of said sleeve;

a stem inserted in said opening of said web member, said stem extending coaxially with said sleeve and having a free end protruding from said sleeve; and a deflection tip mounted on said free end of said stem for radially deflecting the blasting abrasive and the carrier fluid flowing in the given flow direction.

2. The blasting nozzle assembly according to claim 1, which further comprises a Venturi nozzle member integrally and coaxially formed on said inner sleeve at a forward end of said sleeve in the given flow direction.

3. The blasting nozzle assembly according to claim 2, wherein said inner sleeve, said web member, and said Venturi nozzle member are a single-piece unitary structure.

4. The blasting nozzle assembly according to claim 3, wherein said single-piece unitary structure is formed of tungsten carbide.

5. The blasting nozzle assembly according to claim 1, wherein said web member has a length inside said flow channel being at least 80% of the given length of said sleeve.

6. The blasting nozzle assembly according to claim 1, wherein said web member has a length inside said flow channel between 80% and 90% of the given length of said sleeve.

* * * * *